US007142791B2

(12) United States Patent
Yuge

(10) Patent No.: US 7,142,791 B2
(45) Date of Patent: Nov. 28, 2006

(54) IMAGE FORMING APPARATUS AND IMAGE FORMING METHOD

(75) Inventor: Keiji Yuge, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 225 days.

(21) Appl. No.: 10/863,751

(22) Filed: Jun. 9, 2004

(65) Prior Publication Data

US 2005/0276639 A1 Dec. 15, 2005

(51) Int. Cl.
*G03G 15/00* (2006.01)
*G03G 21/10* (2006.01)

(52) U.S. Cl. ..... 399/44; 399/359

(58) Field of Classification Search ..... 399/359, 399/44, 71

See application file for complete search history.

(56) References Cited

U.S. PATENT DOCUMENTS 6,173,132 B1 * 1/2001 Kida et al. ..... 399/44

FOREIGN PATENT DOCUMENTS

JP 10-97165 A 4/1998
JP 10240093 A * 9/1998
JP 2003280472 A * 10/2003

* cited by examiner

*Primary Examiner*—Susan Lee
(74) *Attorney, Agent, or Firm*—Foley & Lardner LLP

(57) ABSTRACT

An image forming apparatus according to the present invention, comprising: a cleaner portion adapted for recovering toner remaining on an image carrying surface of an image carrier after a toner image formed on the carrying surface of the image carrier has been transferred onto a transfer material; a recovered-toner transporting portion adapted for transporting the toner recovered by the cleaner portion to a developing portion adapted for supplying the toner onto the image carrying surface; a temperature detecting portion adapted for detecting a temperature relative to the cleaner portion; and a controlling portion adapted for additionally operating the recovered-toner transporting portion over a predetermined period of time beyond a predetermined operation termination timing when the temperature detected by the temperature detecting portion exceeds a predetermined temperature. With this configuration, it is possible to stably provide the images without any defect by this image forming apparatus equipped with a toner-recycle mechanism.

22 Claims, 10 Drawing Sheets

IMAGE FORMING APPARATUS AND IMAGE FORMING METHOD

BACKGROUND OF THE INVENTION

1. Field of the Invention

The present invention relates to an image forming apparatus and an image forming method.

2. Description of the Related Art

In a traditional image forming apparatus, the following procedures are carried out: an electrostatic latent image is formed on a photosensitive surface of a photosensitive drum as an image carrier followed by developing the latent image to be made visible on the photosensitive surface as a toner image. Subsequently, the visualized toner image is transferred to a paper, and that transferred toner image is fixed on the paper.

Also, the traditional image forming apparatus as described above can employ a well-known toner recycle technology so as to clean and remove residual toner remaining on the photosensitive drum by a cleaner portion after the toner image has been transferred onto a sheet and transport the resultant recovered toner (hereinafter, referred to as "recycle toner") to a developing portion for recycling.

On the meantime, in the event that the size of such an image forming apparatus is intended to be entirely reduced, a fixer as a heat source and the cleaner portion are often disposed to be close to each other. In this case, the temperature of or relative to the cleaner portion is liable to elevate due to thermal influence from the fixer or the like after an image forming operation has been terminated. In particular, such a temperature elevation of the cleaner portion is remarkably manifested immediately after the termination of the image forming operation.

In the image forming apparatus employing the toner recycle technology, there often exists within the cleaner portion the recycle toner (or recovered-toner) which has been recovered from the photosensitive surface of the photosensitive body but not yet transported to the developing portion. When the temperature of the cleaner portion is elevated to excess on the condition that there exists the recycle toner therein, a thermal stress is rendered to the toner.

If the recycle toner within the cleaner portion undergoes the thermal stress as mentioned above, it is liable to clump, thereby disadvantageously leading to deterioration in picture quality (a so-called "clump-fog") of the image formed on a paper sheet material. Further, electrical chargeability of the recycle toner is deteriorated, thereby disadvantageously leading to a so-called "fog" on the image formed on the paper sheet material.

SUMMARY OF THE INVENTION

In order to overcome these problems as described above, an image forming apparatus and an image forming method are provided according to the present invention. An object of the present invention is to surely form an image without any defects by the image forming apparatus equipped with a toner recycling mechanism.

In order to overcome the above-mentioned problems, an image forming apparatus according to a first embodiment of the present invention, comprises:

a cleaner portion adapted for recovering toner remaining on an image carrying surface of an image carrier after a toner image formed on the carrying surface of the image carrier has been transferred onto a transfer material;

a recovered-toner transporting portion adapted for transporting the toner recovered by the cleaner portion to a developing portion adapted for supplying the toner onto the image carrying surface;

a temperature detecting portion adapted for detecting a temperature relative to the cleaner portion; and a controlling portion adapted for additionally operating the recovered-toner transporting portion over a predetermined period of time beyond a predetermined operation termination timing when the temperature detected by the temperature detecting portion exceeds a predetermined temperature.

Also, an image forming apparatus according to a second embodiment of the present invention, comprises:

a cleaner portion adapted for recovering toner remaining on an image carrying surface of an image carrier after a toner image formed on the carrying surface of the image carrier has been transferred onto a transfer material;

a cooling portion adapted for cooling the cleaner portion;

a temperature detecting portion adapted for detecting a temperature relative to the cleaner portion; and a controlling portion adapted for additionally operating the cooling portion over a predetermined period of time beyond a predetermined operation termination timing when the temperature detected by the temperature detecting portion exceeds a first predetermined temperature.

On the other hand, an image forming method according to the first embodiment of the present invention, comprising:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a predetermined temperature; and a control step wherein, if it is determined in the temperature detection step that the detected temperature exceeds the predetermined temperature, then a recovered-toner transporting portion adapted for transporting toner recovered by a cleaner portion toward a developing portion adapted for supplying the toner to the carrier surface of the image carrier is additionally operated over a predetermined period of time beyond a predetermined operation termination timing.

Also, an image forming method according to the second embodiment of the present invention, comprising the steps:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a first predetermined temperature; and a control step wherein, if it is determined in the temperature detection step that the detected temperature exceeds the first predetermined temperature, then a cooling portion adapted for cooling the cleaner portion is additionally operated over a predetermined period of time beyond a predetermined operation termination timing.

EMBODIMENTS OF THE PRESENT INVENTION

Hereinafter, embodiments of the present invention will be described in detail with reference to the accompanying drawings.

First Embodiment

Figure 1:
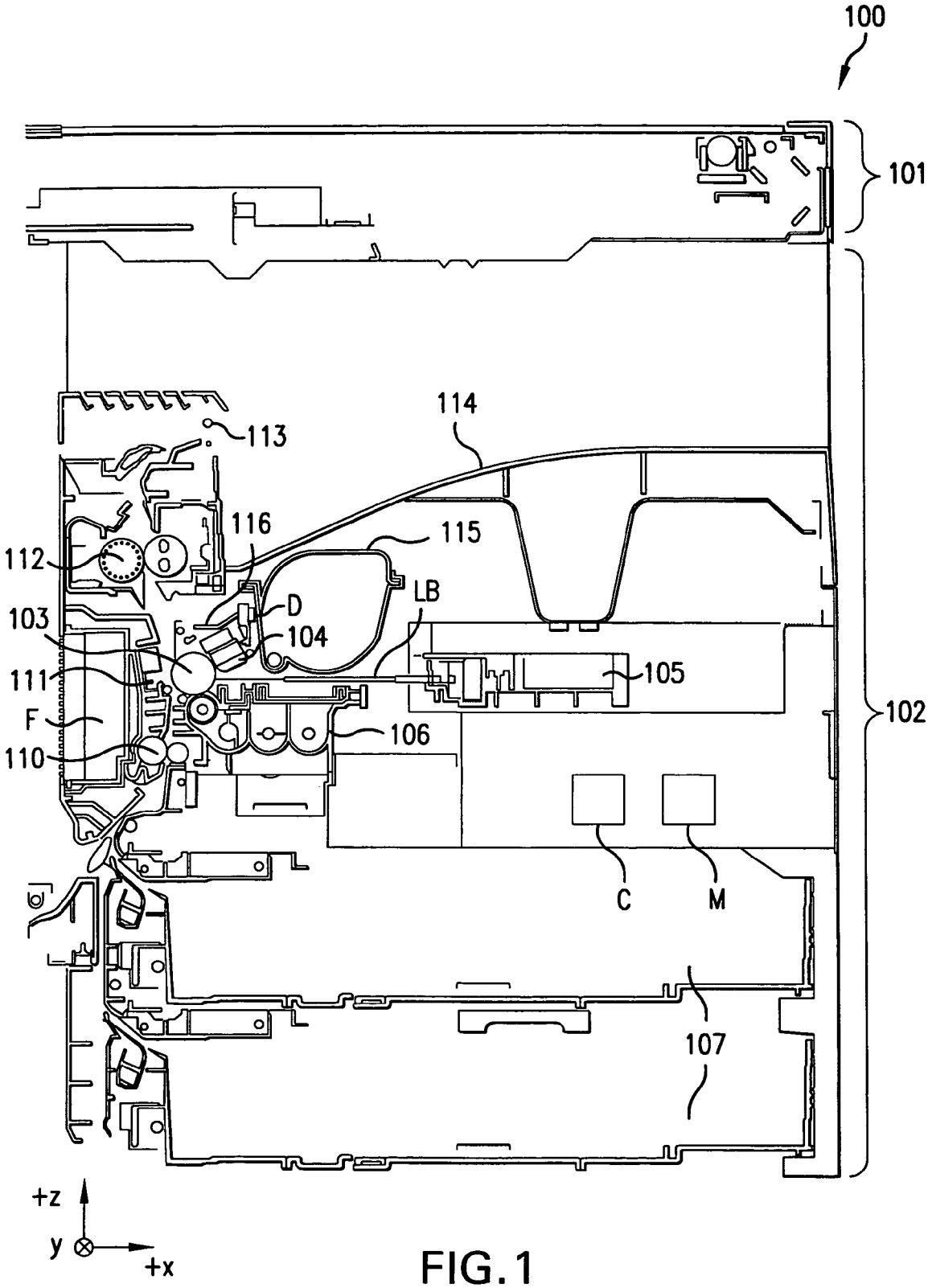
FIG. 1 is a schematic overall configuration of an image forming apparatus according to a first embodiment of the present invention.
Figure 2:
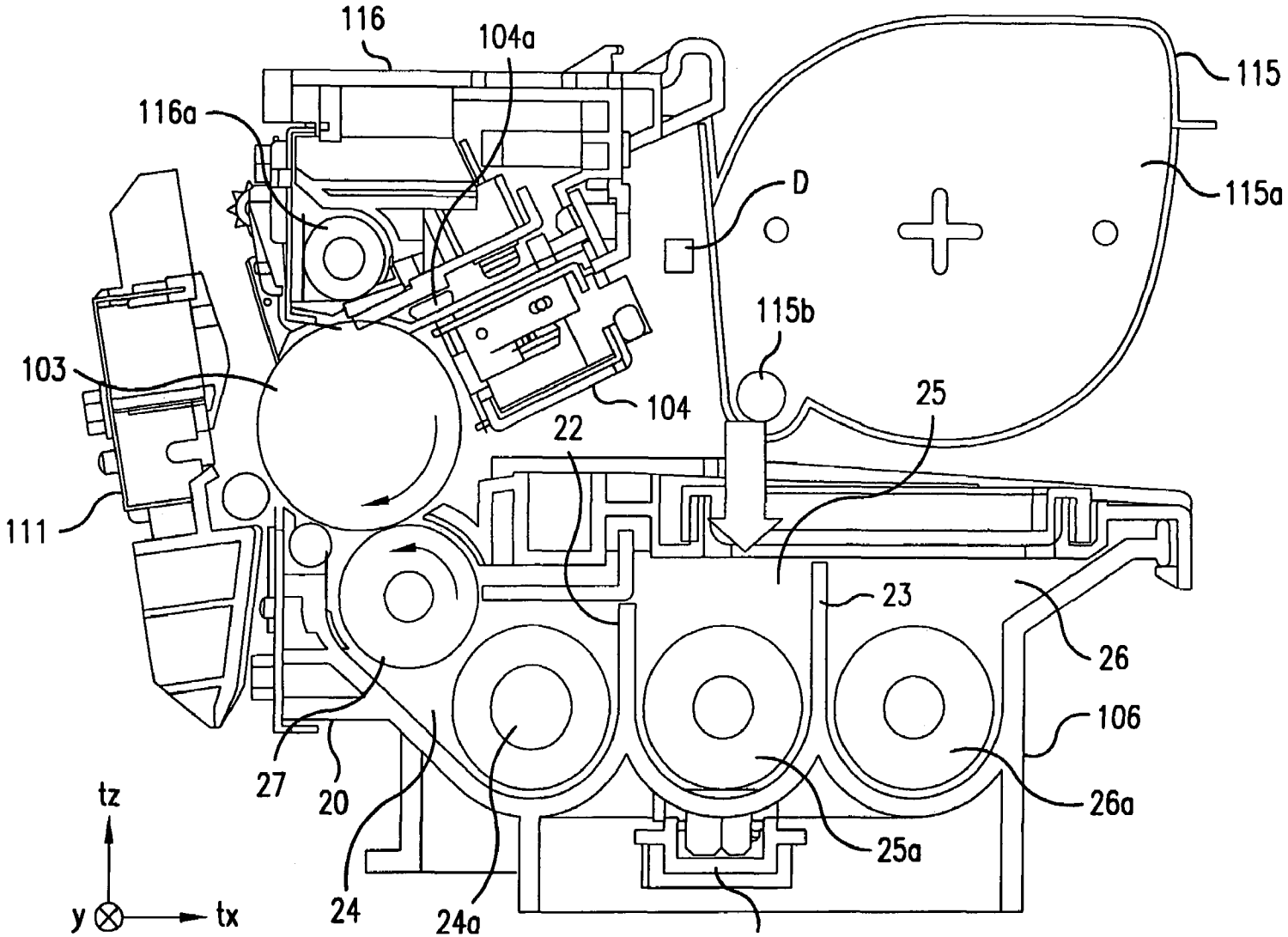
FIG. 2 is an enlarged schematic sectional view illustrating a photosensitive drum (as an image carrier) of the image forming apparatus and its neighboring periphery.
Figure 3:
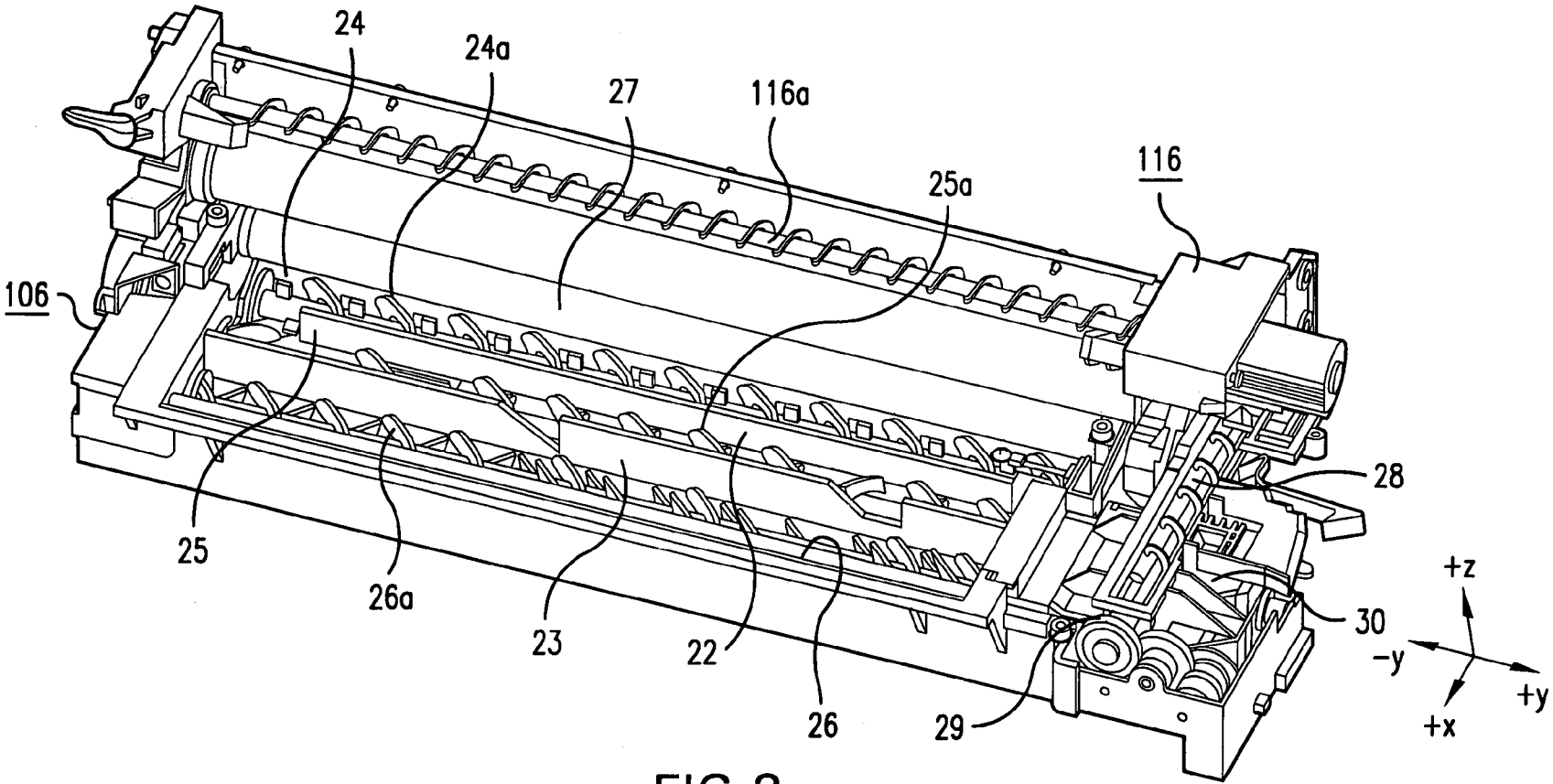
FIG. 3 is an enlarged schematic perspective view illustrating a configuration of a developing and cleaner portions and their peripheries of the image forming apparatus.

FIG. 1 is a schematic overall configuration of an image forming apparatus according to a first embodiment of the present invention, FIG. 2 is an enlarged schematic sectional view illustrating a photosensitive drum (as an image carrier) of the image forming apparatus and its neighboring periphery, and FIG. 3 is an enlarged schematic perspective view illustrating a configuration of a developing and cleaner portions and their peripheries of the image forming apparatus.

As shown in these Figures, the image forming apparatus 100 according to this first embodiment of the present invention, comprises an image reading section (scanner) 101 adapted for reading an image on an original or document and an image forming section 102 adapted for forming an image on a sheet (a transfer material) based on an image signal which is read from the document by the image reading section 101 or which is inputted from an external device.

The image forming section 102 comprises: a photosensitive drum 103; an electrical charger 104; an exposure portion 105; a developing portion 106; sheet cassettes 107; an aligning roller 110; a transfer portion 111; a fixing portion 112; a paper discharging roller 113; a discharged paper tray 114; a fresh-toner replenishing portion 115; a cleaner portion 116; a temperature detecting portion D; a cooling fan (cooling portion) F; a controlling portion C; and a storage portion M. In these various parts, the controlling portion C is a Central Processing Unit (CPU), for example, and the storage portion M is a memory such as FROM and RAM.

The photosensitive drum 103 is configured to have a photosensitive body as an outer circumferential surface thereof. When the entire photosensitive body (photosensitive surface) remains evenly at a predetermined electrical potential, regions thereon are varied in electrical potential by applying an optical irradiation onto those regions, as a result of which an electrical latent image is formed and kept for a predetermined period of time. A rotational axis of the photosensitive drum 103 is substantially parallel to a y-axis direction as shown in FIGS. 1 through 3.

The electrical charger 104 functions to charge a photosensitive surface of the photosensitive drum 103 (the image carrier) at a predetermined electrical potential.

The exposure portion 105 functions to expose the photosensitive surface of the photosensitive drum 103 to a laser beam LB whose emission conditions can be modified based on the image signal supplied from the image reading portion 101 or inputted from the external device. An (exposure) irradiation position of the laser beam LB by this exposure portion 105 is located downstream of the electrical charger 104 along a moving direction of the photosensitive surface of the photosensitive drum 103. In particular, the irradiation of the laser beam LB from the exposure portion 105 can be variably operated in dependence on a concentration of the image to be formed on the sheet.

The developing device 106 is disposed downstream of the exposure irradiation position along the moving direction of the photosensitive surface of the photosensitive drum 103 and accommodates-therein a two-component developer composed of carrier and toner (Hereinafter, referred to simply as a "developer") so as to supply the developer to the photosensitive surface of the photosensitive drum 103. In this manner, an electrostatic latent image formed on the photosensitive surface of the photosensitive drum 103 is made visible for forming the toner image thereon.

Each of the sheet cassettes 107 is configured to accommodate therein a plurality of sheets in the form of a stack. A sheet that has been taken out by a pick-up roller from the sheet cassette 107 and supplied to a transporting roller is transported through a sheet transporting path to the aligning roller 110. The aligning roller 110 is rotated at a predetermined timing so as to achieve a positional alignment between the sheet transported by the transporting roller and the toner image formed on the photosensitive surface of the photosensitive drum 103 and then transport that sheet to a transfer position.

The transfer portion 111 functions to transfer the toner image to the sheet by charging the sheet at a predetermined electrical potential.

The fixing portion 112 functions to perform a predetermined thermal process and pressurized process on the sheet to which the toner image has been transferred by the transfer portion 111 to fix the toner image onto the sheet.

The paper discharging roller 113 functions to discharge the sheet onto which the toner image has been fixed into the discharged paper tray 114.

The fresh-toner replenishing portion 115 functions to, at a predetermined timing, supply the developing device 106 with new toner which has not yet is used for forming any image based on a detection signal (corresponding to a toner specific concentration) from a magnetic sensor 21 provided in the developing portion 106.

The cleaner portion 116 is located, along the moving direction of the photosensitive surface of the photosensitive drum 103, downstream of a transfer position at which the photosensitive drum 103 and the transfer portion 111 confront each other and functions to recover residual toner attached on the photosensitive surface. The cleaner portion 116 comprises a recovered-toner transporting roller 116*a* adapted for transporting recovered toner in a direction of +y as shown in FIG. 3. More specifically, the cleaner portion 116 functions to recover the residual toner remaining on an image carrying surface of the image carrier after the toner image on the image carrying surface has been transferred to the sheet (transfer medium).

The temperature detecting portion D is disposed in proximity to the cleaner portion 116 and functions to detect a temperature relative to the cleaner portion 116.

The cooling fan F functions to cool the cleaner portion 116 and its vicinities.

Finally, the controlling portion C functions to perform controlling of various components of the image forming apparatus, while the storage portion M functions to store programs and the like for controlling the components of the image forming apparatus by the controlling portion C.

Along the moving direction of the photosensitive surface of the photosensitive drum 103 are the electrical charger 104 and a discharging lamp 104*a* disposed upstream of a developing position at which the photosensitive surface and the developing device 106 confront each other while the transfer portion 111 and the cleaner portion 116 in this order are disposed downstream of that developing position (see FIG. 2).

The fresh-toner replenishing portion 115 comprises a fresh-toner cartridge 115*a* for accommodating therein fresh toner and a supply roller 115*b* which is rotated at a predetermined timing by a non-shown motor to supply the fresh toner in the developing device 106.

The developing device 106 comprises: a developer vessel 20 for accommodating therein the developer; and a magnetic sensor 21 for detecting a concentration of toner accommodated in the developer vessel 20. The magnetic sensor 21 is disposed at a lower portion of the developer vessel 20.

The developing vessel 20 includes: a first chamber 24; a second chamber 25; and a third chamber 26 respectively partitioned by first and second partitions 22 and 23 each having a predetermined length in a direction parallel to the rotational axis of the photosensitive drum 103.

The predetermined length of the first partition 22 is designed such that adjacent spaces of the first and second chambers 24 and 25 in vicinity of opposite ends of that partition in its longitudinal direction can communicate with each other. Similarly, the predetermined length of the second partition 23 is designed such that adjacent spaces of the second and third chambers 25 and 26 in vicinity of opposite ends of that partition in its longitudinal direction can communicate with each other.

The first, second and third chambers 24, 25, 26 have therein first, second and third mixers 24*a*, 25*a*, 26*a* respectively, each having a rotational axis substantially parallel to the rotational axis of the photosensitive drum 103.

Particularly, in the first chamber 24, there is disposed a developing roller 27 that confronts the photosensitive surface of the photosensitive drum 103 at the developing position to pass the toner to that photosensitive surface and that is rotatable about a rotational axis serving as a center for rotation and arranged substantially parallel to the rotational axis of the photosensitive drum 103.

The first mixer 24*a* is rotated and adapted for transporting the toner in the +y direction while agitating it in the first chamber 24. The second mixer 25*a* is rotated and adapted for transporting the toner in a direction of −y while agitating it in the second chamber 25. The third mixer 26*a* is rotated and adapted for transporting the toner in the −y direction while agitating it in the third chamber 26.

In the vicinity of an end of the developing portion 106 in the +y direction, there is provided a recycle toner supply mechanism (recovered-toner transporting portion) 28 adapted for transporting recycle toner (recovered-toner) supplied from the recovered-toner transporting roller 116*a* of the cleaner portion 116 to the third chamber 26.

The recycle toner supply mechanism (or recovered-toner transporting portion) 28 is a mixer having a rotational axis which is inclined at a predetermined angle to the rotational axis of the photosensitive drum 103 and on which a spiral vane(s) is formed to transport the toner by its rotational movement about the rotational axis as a center for rotation. Specifically, the recycle toner supply mechanism 28 functions to transport the toner recovered by the cleaner portion 116 to the developing portion 106 for supplying the image carrying surface with the toner.

More specifically, the recycle toner transported by the recycle toner supply mechanism 28 is supplied to a recycle toner supply portion 29 located in vicinity of an end of the +y direction in the third chamber 26. That is, the recycle toner supply portion 29 is disposed upstream of a transporting direction (the −y direction) of the toner by the third mixer 26*a*.

Also, in vicinity of an end of the +y direction of the second chamber 25 is a fresh-toner supply portion 30 disposed to receive a replenishment of new toner from the fresh-toner replenishing portion 115. That is, the fresh-toner supply portion 30 is disposed upstream of the transporting direction (the −y direction) of the toner by the second mixer 25*a*.

The third mixer 26*a* receives and transports the recycle toner from the recycle toner supply mechanism 28 and the developer transported through the second chamber 25 by the second mixer 25*a*, while agitating them, to again deliver them to the second mixer 25*a*.

On the other hand, the second mixer 25*a* transports the developer received from the third and first mixers 26*a* and 24*a* and the new toner received from the fresh-toner replenishing portion 115 to the fresh-toner supply portion 30, while agitating them, to deliver them to the first mixer 24*a*.

Then, the first mixer 24*a* delivers the developer received from the second mixer 25*a* while agitating it to the developing roller 27, and simultaneously delivers to the second mixer 25*a* the developer which has already been used for development and exfoliated (or separated) from a roller surface of the developing roller 27.

Thereafter, the recycle toner which has experienced developing and transferring processes is recovered by the cleaner portion 116 from the photosensitive surface of the photosensitive drum 103, transported by the recovered-toner transporting roller 116*a*, and recovered through the recycle toner supply mechanism 28 into the developing portion 106.

According to the present invention, the image forming apparatus 100 is configured to transport the recycle toner by the recovered-toner transporting roller 116*a* and cool the cleaner portion 116 by the cooling fan F during an image forming operation, in order to suppress within the image forming apparatus an excessive temperature elevation (particularly a temperature elevation in vicinity of the cleaner portion 116) occurred when the image forming operation onto the sheet is conducted.

It should be noted that a traditional image forming apparatus is configured to stop operations of its recovered-toner transportation and cooling fan in an interlocking manner with stoppage of its image forming operation. Accordingly, the temperature within the image forming apparatus (and also within the cleaner portion) after the image forming operation has been stopped will often be elevated.

Figure 4:
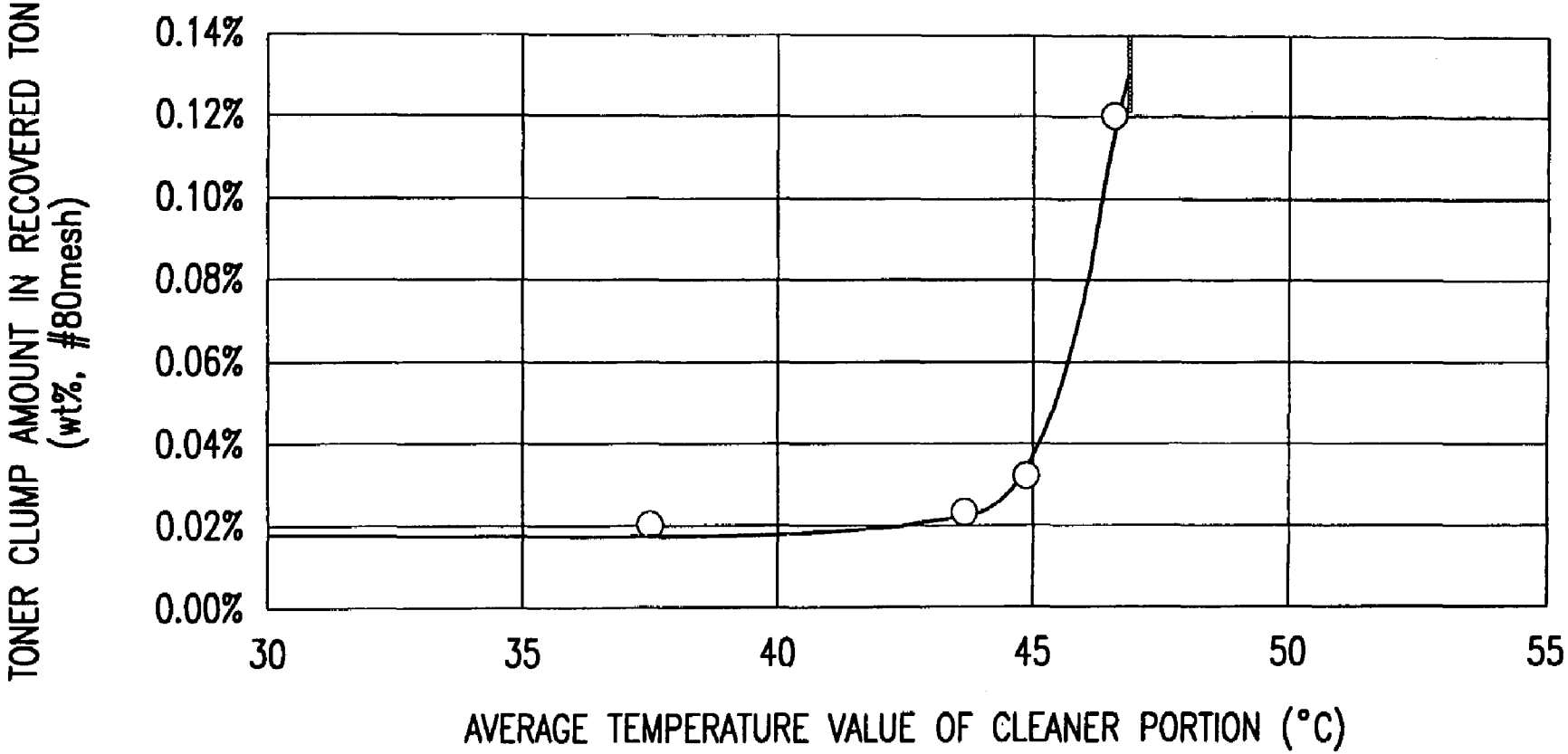
FIG. 4 is a graph for illustrating a relationship between average value in temperature relative to a cleaner portion and clump amount in recycle toner recovered from the cleaner portion.

FIG. 4 is a graph for illustrating a relationship between average values in temperature relative to the cleaner portion and amounts of (toner) clumps (generally what is meant by this clump is an agglomerate formed by clumping together a plurality of toner particles) in the recycle toner recovered from the cleaner portion.

As shown in FIG. 4, it would be appreciated that the (toner) clump amount in the toner recovered by the cleaner portion 116 increases as the temperature relative to the cleaner portion 116 elevates. In particular, the clump amount remarkably increases in the neighborhood of 45° C.

In the traditional image forming apparatus, regardless of a high temperature caused by the image forming operation at the fixing portion 112, the cooling fan F stops along with the stoppage of the image forming operation. Therefore, it is believable that the temperature in vicinity of the fixing portion 112 (e.g., the cleaner portion 116 and the like) tends to be elevated to excess.

As a result, when the temperature within the cleaner portion 116 has been elevated to excess, the recycle toner which has been recovered by the cleaner portion 116 remains within the cleaner portion 116 of the high temperature without being cooled down.

According to this first embodiment of the present invention, in order to prevent the clump amount in the recycle toner from being increased under such a condition, the controlling portion C is adapted for controlling the recovered-toner transporting portion to be additionally operated over a predetermined period of time beyond a predetermined operation termination timing when the temperature detected by the temperature detecting portion D exceeds a predetermined temperature. This predetermined operation termination timing is generally set as a timing which is preset in association with the operation of the image forming apparatus.

With the configuration described above, it is possible to refuge the recycle toner remaining within the cleaner portion 116 at a high temperature from that cleaner portion 116 during the additional operation of the recovered-toner transporting portion for the predetermined period of time after the predetermined operation termination timing (e.g., the stoppage of the image forming operation. That is, it is possible to prevent the clump amount from being increased in the recycle toner by refuging from a high temperature condition the recycle toner remaining within the cleaner portion 116.

Figure 5:
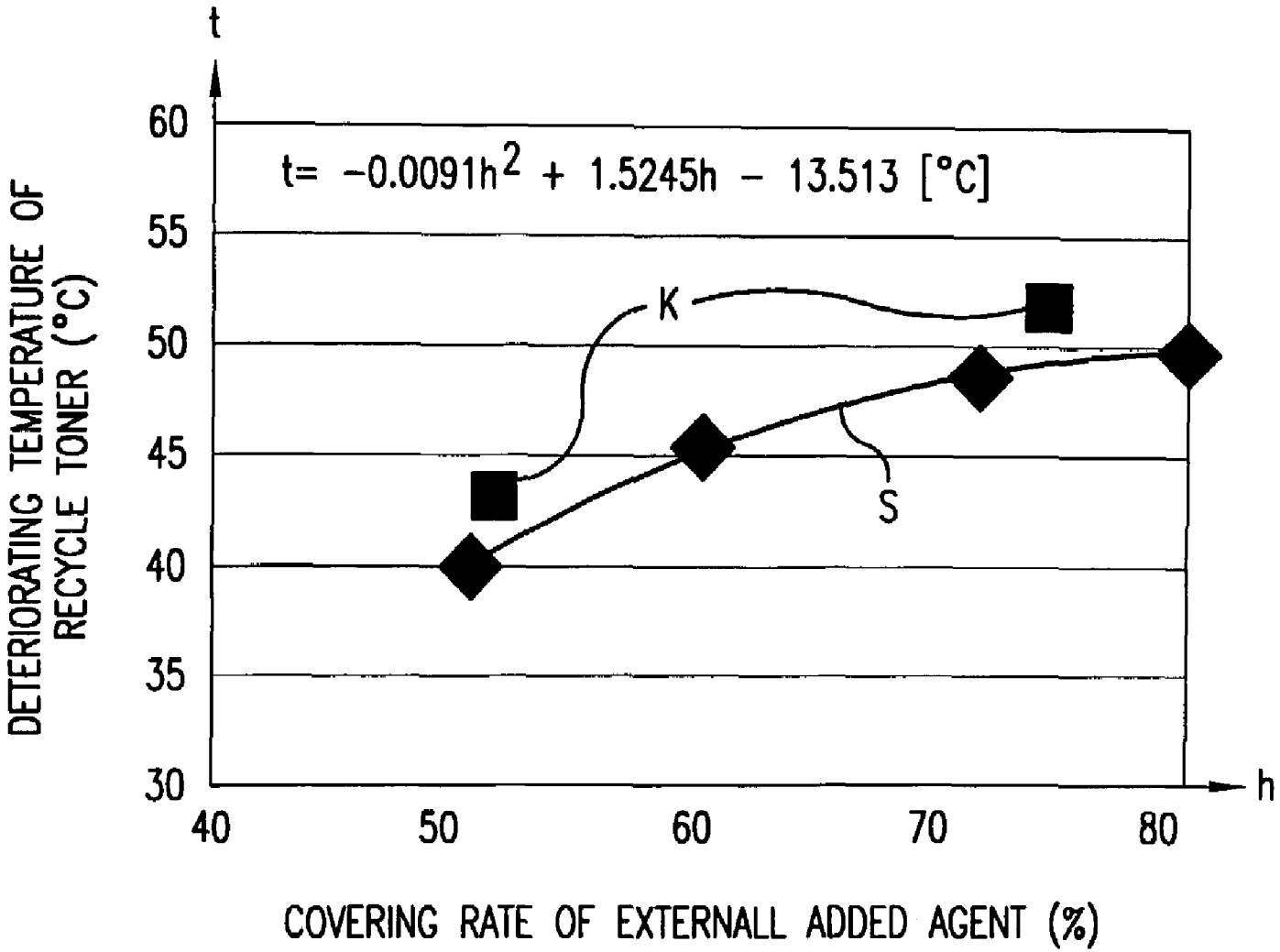
FIG. 5 is a graph for illustrating a relationship between covering rate of externally added agent to toner (particle) surface and deteriorating temperature of the recycle toner.

FIG. 5 is a graph for illustrating a relationship between covering rate (%) of externally added agent to toner (particle) surface and deteriorating temperature (° C.) of the recycle toner.

In general, externally added agent to toner surface functions to perform the control of electrical charging of the toner. If the toner is subjected to any stress such as a thermal stress so that a deposition condition of this externally added agent onto the toner surface changes (e.g., embedment of externally added agent into the toner), it is liable to readily result in deterioration in picture quality of any image formed on the sheet (so-called "clump image" and/or "fog image"). It will be appreciated that, as the toner has a higher covering rate of the externally added agent, the toner is characteristically unliable to deteriorate even at a high temperature.

In the graph as shown in FIG. 5, data K indicated by a symbol "■" represents a state in which the deterioration in quality of an image is caused; data indicated by a symbol "◆" represents the highest temperature at which the deterioration in quality of an image is not caused over some covering rates; and a curve S represents a temperature serving as a threshold value at which the deterioration in quality of an image is not caused over some covering rates.

Here, in the event that the covering rate of the externally added agent to the toner surface is indicated by h (%) and the deterioration temperature of the recycle toner is indicated by t (° C.), the curve S is represented by:

$$-0.0091h^2+1.5245h-13.513[^\circ\ C.].$$

Therefore, according to this first embodiment of the present invention, the predetermined temperature as the threshold value for performing the additional operation of the recovered-toner transporting portion is set to approximately $-0.0091\ h^2+1.5245h-13.513°$ C. or less where the covering rate of the externally added agent to the toner surface is indicated by h (%).

Also, according to this first embodiment of the present invention, the temperature detecting portion D is configured to perform the temperature detection at the predetermined operation termination timing described above.

Figure 6:
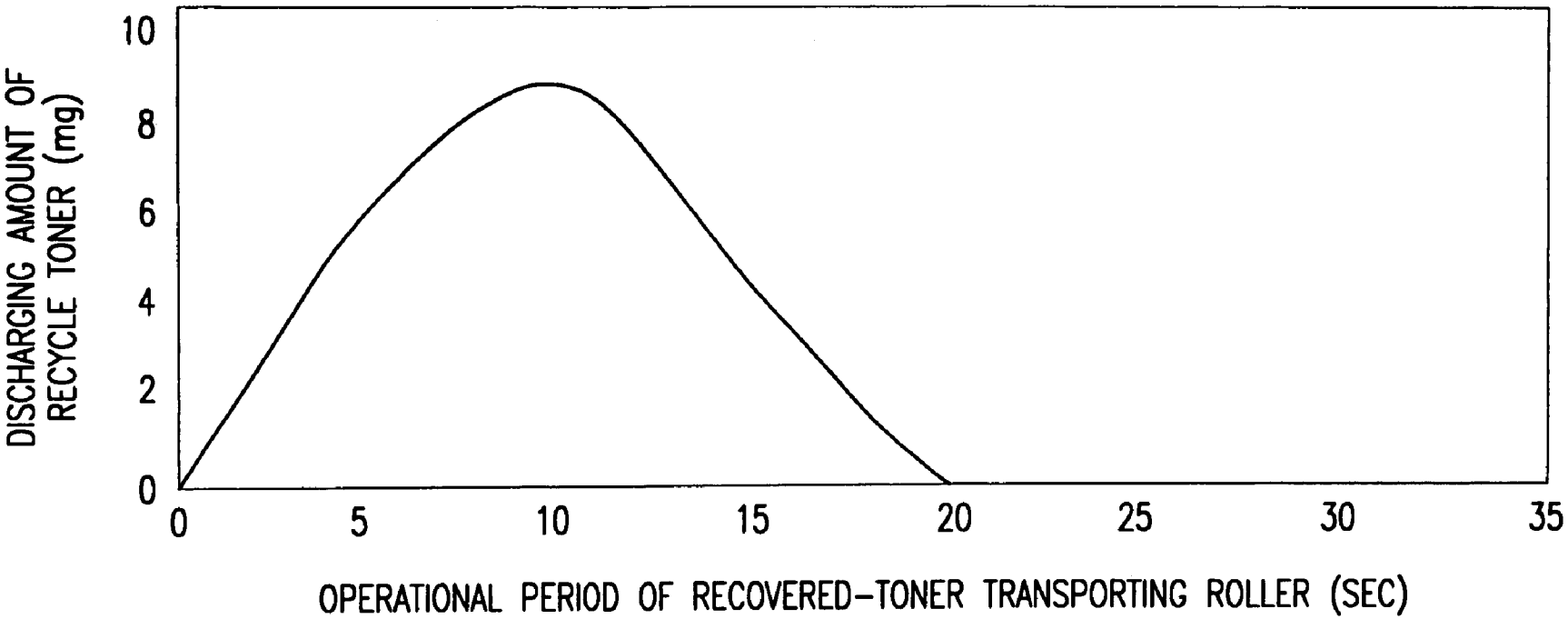
FIG. 6 is a graph for illustrating a relationship between operational elapsed time of a recovered-toner transporting roller and a discharging amount of the recycle toner from an interior of the cleaner portion.

FIG. 6 is a graph for illustrating a relationship between operational elapsed time (the recycle-toner transporting time)(sec) of the recovered-toner transporting roller 116*a* and a discharging amount (mg) of the recycle toner from an interior of the cleaner portion. Here, it is exemplified that the recovered-toner transportation is performed from a state in which a plenty of the recycle toner is contained within the cleaner portion 116. As shown in FIG. 6, if the recovered-toner transporting roller 116*a* runs for approximately 20(sec), it is evident that substantial all of the recycle toner can be discharged from the cleaner portion 116.

Figure 7:
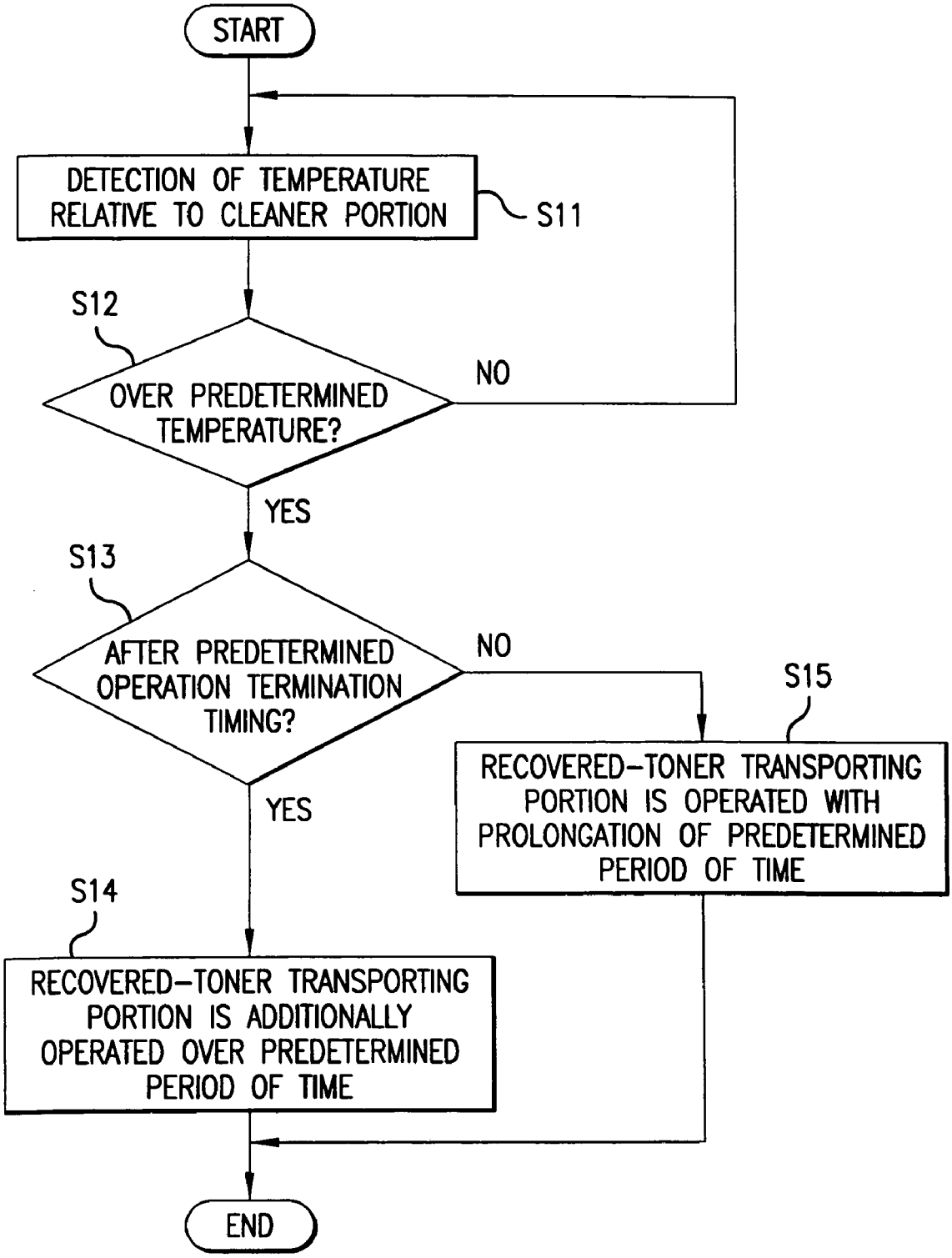
FIG. 7 is a flow chart showing a process flow of the image forming apparatus according to the first embodiment of the present invention.

FIG. 7 is a flow chart showing a process flow of the image forming apparatus according to this first embodiment of the present invention.

Firstly, the temperature is detected relative to the cleaner portion 116 adapted for recovering the toner remaining on the image carrying surface of the image carrier in step 11 [temperature detection step].

Next, it is determined in step 12 whether or not the detected temperature obtained in the temperature detection step exceeds a predetermined temperature [temperature determination step].

As a result of that determination, if the detected temperature does not exceed the predetermined temperature (step 11: No), then the process flow returns to the temperature detection step 11. Thus, the temperature detecting portion D is configured to constantly detect the temperature relative to the cleaner portion 116 not only during the image forming operation but also after termination of the image forming operation.

On the other hand, if the detected temperature exceeds the predetermined temperature (step 12: Yes), then it is determined in step 13 whether or not the time when the temperature has exceeded the predetermined temperature is after the predetermined operation termination timing.

As a result of that determination, if that time is after the predetermined operation termination timing (step 13: Yes), the recycle toner supply mechanism (the recovered-toner transporting portion) 28 is additionally operated over a predetermined period of time beyond the predetermined operation timing in step 14 [control step].

On the other hand, as a result of that determination, if that time is before the predetermined operation termination timing (step 13: Yes), the recycle toner supply mechanism (recovered-toner transporting portion) 28 is operated with a prolongation of only the predetermined period of time from the predetermined operation timing (without any stoppage of the recovered-toner transporting portion 28) in step 15.

With various steps described above, the image forming method according to this first embodiment of the present invention is achieved.

In particular, the predetermined period of time for which the recovered-toner transporting portion 28 should be additionally operated beyond the predetermined operation termination timing at the control step based on the temperature detected at the temperature detection step may be varied by the controlling portion C.

Second Embodiment

Next, a second embodiment of the present invention will be described in detail.

This second embodiment of the present invention is a variation of the first embodiment and like reference numbers therebetween indicate like elements. Therefore explanations of the like elements are omitted hereinafter. This second embodiment is distinct in process flow from the first embodiment.

In detail, the image forming apparatus according to this second embodiment of the present invention is configured to control the cooling portion F to be additionally operated over a predetermined period of time beyond a predetermined operation termination timing by the controlling portion C when a temperature detected by the temperature detecting portion D exceeds a first predetermined temperature. This predetermined operation termination timing is generally set as a timing which is preset in association with the operation of the image forming apparatus. Specifically, at the time when the image forming operation is terminated or after the termination of the image forming operation, the cooling portion F disposed on the periphery of the cleaner portion 116 is configured to be additionally operated, until the temperature relative to the cleaner portion 116 lowers to a certain temperature, based on information of the temperature detected by the temperature detecting portion D disposed at such a position as to directly detect or readily infer the temperature relative to (or of an interior of) the cleaner portion 116.

Thus, after the predetermined operation termination timing (e.g., the stoppage of the image forming operation) to terminate the operation of the cooling portion F, it is possible to cool down the recycle toner remaining in the cleaner portion 116 at a high temperature by the additional operation over the predetermined period of time of the cooling portion F. That is, in order to avoid an exposure of the recycle toner remaining in the cleaner portion 116, in particular in a state in which the recycle toner remains on a blade of the cleaner portion 116, to a high temperature ambience over a long period of time (thermal stress), the clump amount in the recycle toner can be prevented from being increased.

Figure 8:
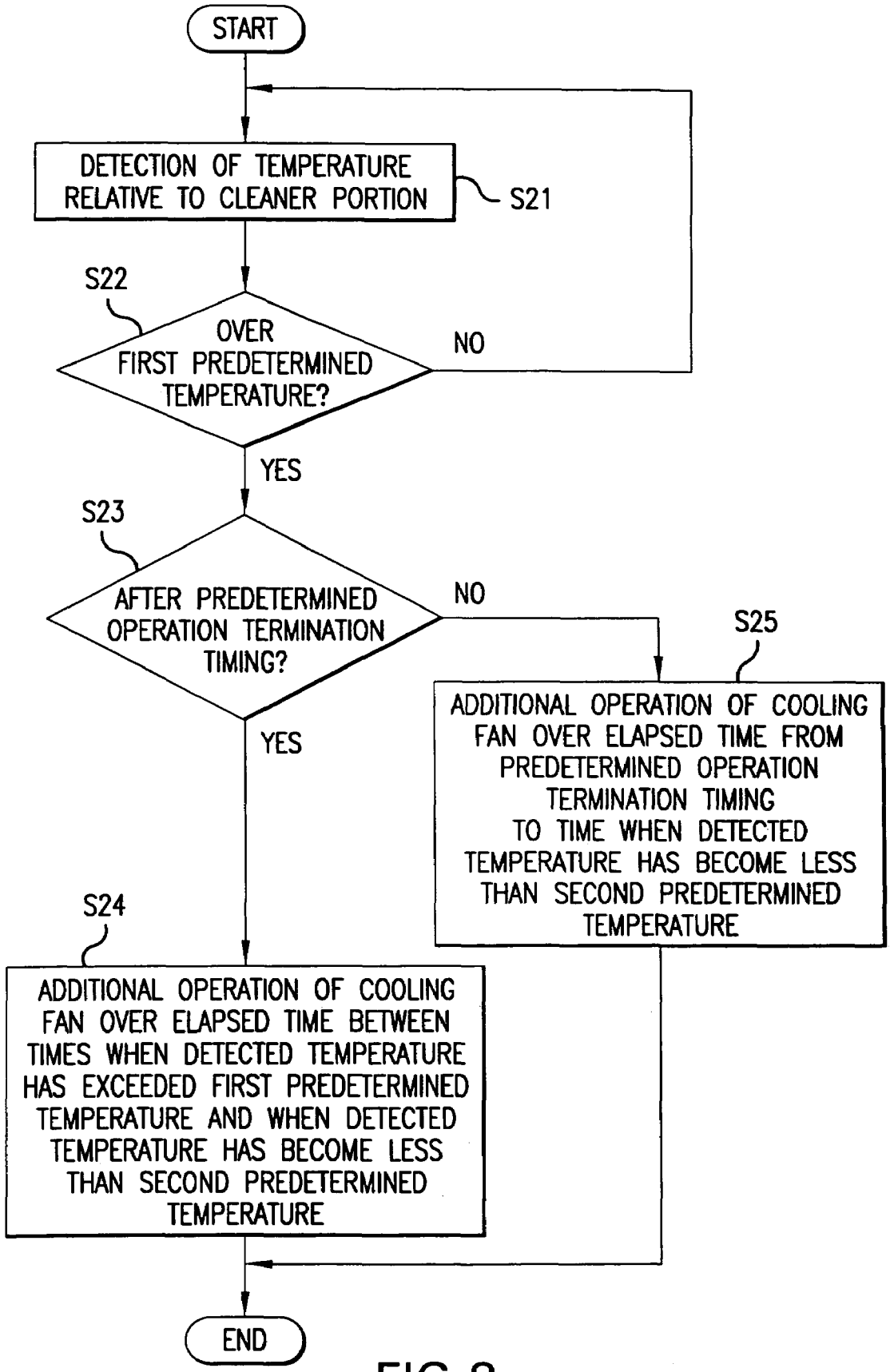
FIG. 8 is a flow chart showing a process flow of the image forming apparatus according to a second embodiment of the present invention.

FIG. 8 is a flow chart showing a process flow of the image forming apparatus according to this second embodiment of the present invention.

Firstly, the temperature is detected relative to the cleaner portion 116 adapted for recovering the toner remaining on the image carrying surface of the image carrier in step 21 [temperature detection step].

Next, it is determined in step 22 whether or not the detected temperature obtained in the temperature detection step exceeds a first predetermined temperature (corresponding to the predetermined temperature described in the first embodiment) [temperature determination step].

As a result of that determination, if the detected temperature does not exceed the first predetermined temperature (step 22: No), then the process flow returns to the temperature detection step 21. Thus, the temperature detecting portion D is configured to constantly detect the temperature relative to the cleaner portion 116 not only during the image forming operation but also after termination of the image forming operation.

On the other hand, if the detected temperature exceeds the first predetermined temperature (step 22: Yes), then it is determined in step 23 whether or not the time when the temperature has exceeded the first predetermined temperature is after the predetermined operation termination timing.

As a result of that determination, if that time is after the predetermined operation termination timing (step 23: Yes), the cooling portion F is additionally operated over a predetermined period of time beyond the predetermined operation timing in step 24 [control step]. It should be noted that this predetermined period of time is an elapsed time between the time when the detected temperature has exceeded the first predetermined temperature and the time when the detected temperature has become less than a second predetermined temperature.

On the other hand, as a result of that determination, if that time is before the predetermined operation termination timing (step 23: No), the cooling portion F is operated with a prolongation of only the predetermined period of time from the predetermined operation termination timing in step 25. It should be noted that this prolonged predetermined period of time is an elapsed time between the predetermined operation termination timing and the time when the detected temperature becomes less than the second predetermined temperature.

With various steps described above, the image forming method according to this second embodiment of the present invention is achieved.

Additionally, it would be preferable to set the second predetermined temperature to be lower than the first predetermined temperature, but is not limited to according to the present invention. There is no problem in the case of the second predetermined temperature being set to be equal to the first predetermined temperature. Also, in this second embodiment, the first predetermined temperature is set to such a level as to impair chargeability of the toner (corresponding to the predetermined temperature in the first embodiment), but is not limited to according to the present invention. On the assumption that the temperature in an interior of the image forming apparatus will be overshot later on by the temperature relative to the cleaner portion at the time when the image forming operation has been terminated, it may also be preferable to additionally operate the cooling fan F even if the temperature relative to the cleaner portion 116 at the time when the image forming operation has been terminated does not attain to the level for impairing the chargeability, thereby lowering the temperature in the interior of the image forming apparatus to be lower than a certain temperature.

Figure 9:
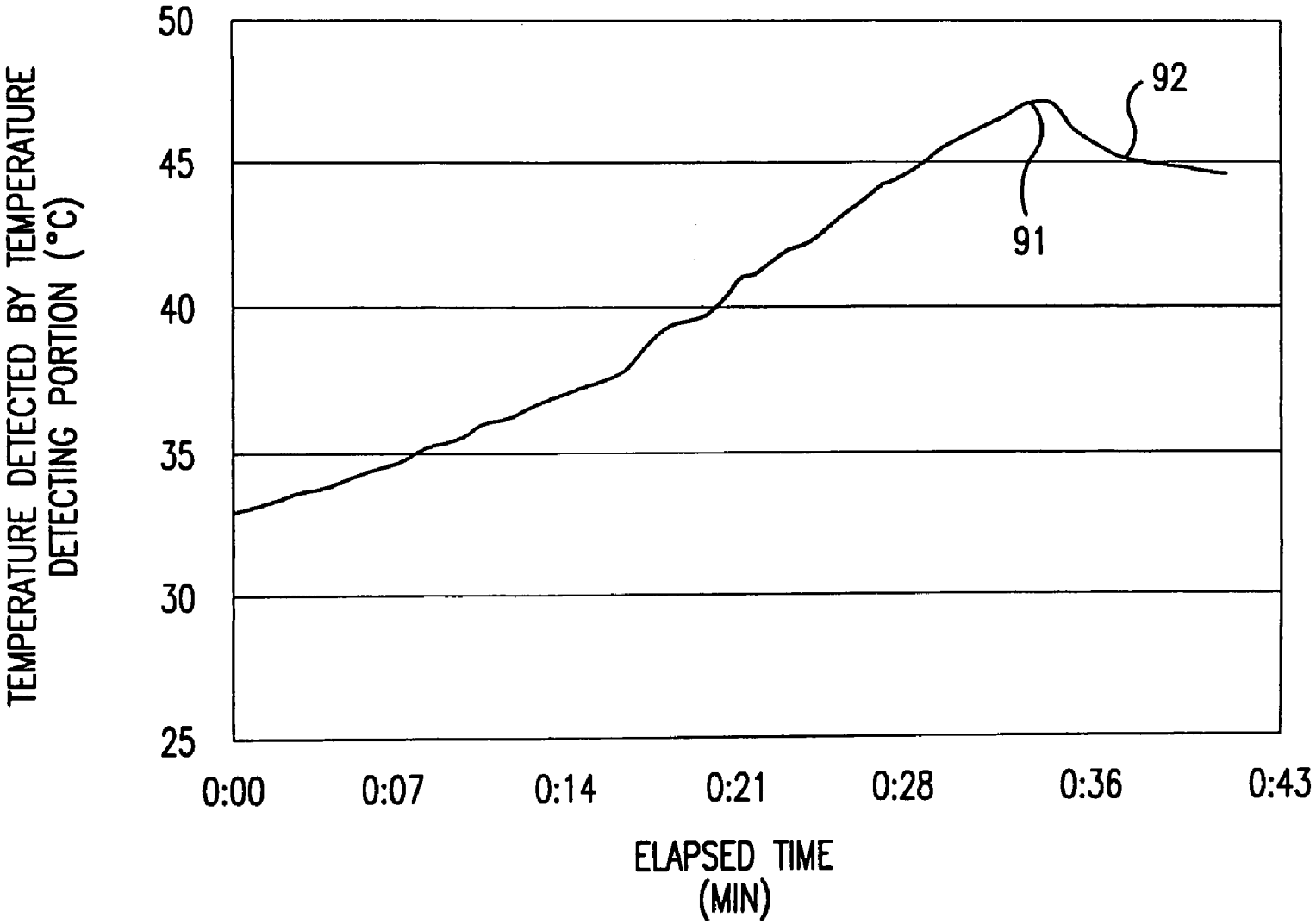
FIG. 9 is a graph for illustrating a relationship between elapsed time versus temperature detected by temperature detecting portion in the image forming apparatus according the second embodiment of the present invention.

FIG. 9 is a graph for illustrating a relationship between elapsed time (min) versus temperature (° C.) detected by the temperature detecting portion D in the image forming apparatus according the second embodiment of the present invention. Here, it is assumed that 47° C. is set as the first predetermined temperature and 45° C. is set as the second predetermined temperature.

As shown in FIG. 9, the temperature detected by the temperature detecting portion D continues to rise, while the image forming operation by the image forming apparatus is continuously performed, until a point in time 91 when the image forming operation is terminated (i.e., the detected temperature is in excess of 47° C. at the time of termination of the image forming operation).

On arrival at the point of time 91 when the image forming operation is terminated (i.e., the predetermined operation termination timing), the cooling fan F performs a 2-minute cooling operation so that the detected temperature also gradually falls with time. The detected temperature continues to fall until a point of time 92 at which the detected temperature becomes less than the second predetermined temperature (45° C.). At the point of time 92, the cooling fan F is stopped. From this graph as shown in FIG. 9, it would be appreciated that the generation of the clump image and/or fog image is effectively suppressed according to this second embodiment of the present invention.

Figure 10:
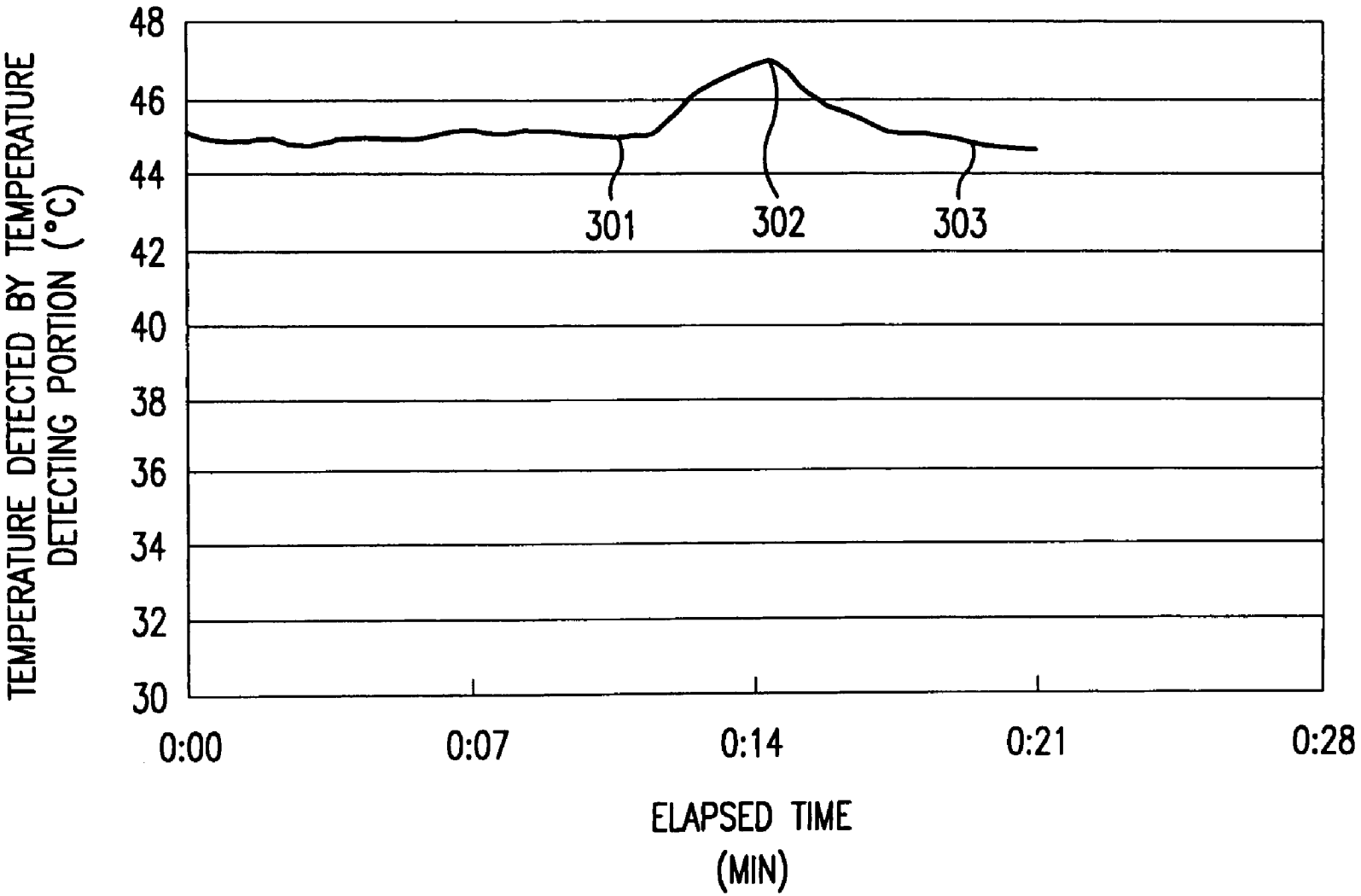
FIG. 10 is a graph for illustrating a relationship between elapsed time versus temperatures detected by temperature detecting portion in the image forming apparatus according the second embodiment of the present invention, under a different condition from that of FIG. 9.

FIG. 10 is a graph for illustrating a relationship between elapsed time versus temperature detected by temperature detecting portion D in the image forming apparatus according the second embodiment of the present invention. Here, it is assumed that 47° C. is set as the first predetermined temperature and 45° C. is set as the second predetermined temperature.

As shown in FIG. 10, the temperature detected by the temperature detecting portion D does not yet exceed the first predetermined temperature (47° C.) at a point of time 301 when the image forming operation by the image forming apparatus is terminated (i.e., a point of time when a waiting state of the apparatus is initiated). Even in such a case, the temperature of an interior of the image forming apparatus can be overshot during the waiting state after the image forming operation termination. Here, if that temperature exceeds the first predetermined temperature (47° C.) (as indicated by reference numeral 302 in FIG. 10), then a cooling operation is performed by the cooling portion F. As a result, the detected temperature falls and then it becomes less than the second predetermined temperature (45° C.). At that point of time, the cooling operation by the cooling fan F is stopped (as indicated by reference numeral 303 in FIG. 10). Also from this graph as shown in FIG. 10, it would be appreciated that the generation of the clump image and/or fog image is effectively suppressed according to this second embodiment of the present invention.

Preferably, the temperature detecting portion in each of the embodiments of the present invention is disposed in vicinity of the cleaner portion, but it is not limited to according to the present invention. For example, in the event that any space for disposing the temperature detecting portion can not be secured in vicinity of the cleaner portion, it may be preferable to disposed the temperature detecting portion at a position which is able to infer the temperature relative to the cleaner portion in the image forming apparatus (e.g., a position which is readily capable of suffering a thermal transmission from the cleaner portion).

Also, the additional operation of the recovered-toner transporting portion according to the first embodiment and the additional operation of the cooling fan according to the second embodiment are separately performed, but is not limited to according to the present invention. Both of these additional operations of the recovered-toner transporting portion and the cooling fan may be performed. Furthermore, in this case, boh of these additional operations of the recovered-toner transporting portion and the cooling fan do not necessarily have to be performed simultaneously. For example, after the recovered-toner transporting portion has firstly been additionally operated, the cooling fan may additionally be operated. As a result, it is advantageously possible to reduce the thermal stress applied to the recycle toner in the cleaner portion.

As described above, according to the first embodiment, it is possible to provide an image forming method comprising:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a predetermined temperature; and a control step wherein, if it is determined in the temperature detection step that the detected temperature exceeds the predetermined temperature, then a recovered-toner transporting portion adapted for transporting the toner recovered by the cleaner portion toward a developing portion adapted for supplying the toner to the carrier surface of the image carrier is additionally operated over a predetermined period of time beyond a predetermined operation termination timing.

In the image forming method as described above, it is preferable that the predetermined period of time to be added for the operation in the control step is varied based on the temperature detected in the temperature detection step. Also, the predetermined operation termination timing can be set as a timing which is preset in association with the operation of the image forming apparatus. In addition, in the control step, when the detected temperature in the temperature detection step exceeds the predetermined temperature prior to the predetermined operation termination timing, it can be configured that the recovered-toner transporting portion is additionally operated with a prolongation of only the predetermined period of time from the predetermined operation timing. Furthermore, it is preferable that the temperature detection in the temperature detection step is performed at the predetermined operation termination timing. The predetermined temperature is set to approximately $-0.0091h^2+1.5245h-13.513°$ C. or less where a covering rate of an externally added agent to a toner surface is indicated by h (%).

As described above, according to the second embodiment, it is possible to provide an image forming method comprising:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a first predetermined temperature; and a control step wherein, if it is determined in the temperature detection step that the detected temperature exceeds the first predetermined temperature, then a cooling portion adapted for cooling the cleaner portion is additionally operated over a predetermined period of time beyond a predetermined operation termination timing.

In the image forming method as described above, it is preferable that, when the detected temperature in the temperature detection step exceeds the first predetermined temperature prior to the predetermined operation termination timing, the predetermined period of time can be set as an elapsed time from the predetermined operation termination timing to the time when the detected temperature has become less than a second predetermined temperature. Also, in the image forming method, when the detected temperature in the temperature detection step exceeds the first predetermined temperature after the predetermined operation termination timing, the predetermined period of time can be set as an elapsed time between the time when the detected temperature has exceeded the first predetermined temperature and the time when the detected temperature has become less than the second predetermined temperature. Further, the predetermined operation termination timing is set as a timing which is preset in association with the operation of the image forming apparatus. Furthermore, the temperature detection in the temperature detection step is performed at the predetermined operation termination timing. The first predetermined temperature is set to approximately $-0.0091h^2+1.5245h-13.513°$ C. or less where a covering rate of an externally added agent to a toner surface is indicated by h (%)

The various steps in these image forming methods are implemented by executing an image forming program stored in the storage portion M under control of the controlling portion C as a computer.

In detail, according to the first embodiment of the present invention, there is provided the image forming program adapted for allowing a computer to execute:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a predetermined temperature; and a control step wherein, if it is determined in the temperature detection step that the detected temperature exceeds the predetermined temperature, a recovered-toner transporting portion adapted for transporting the toner recovered by the cleaner portion toward a developing portion adapted for supplying the toner to the carrier surface of the image carrier is additionally operated over a predetermined period of time beyond a predetermined operation termination timing.

In the image forming program as described above, it is preferable that the predetermined period of time to be added for the operation in the control step is varied based on the temperature detected in the temperature detection step. Also, the predetermined operation termination timing can be set as a timing which is preset in association with the operation of the image forming apparatus. In addition, in the control step, when the detected temperature in the temperature detection step exceeds the predetermined temperature prior to the predetermined operation termination timing, it can be configured that the recovered-toner transporting portion is additionally operated with a prolongation of only the predetermined period of time from the predetermined operation timing. Furthermore, it is preferable that the temperature detection in the temperature detection step is performed at the predetermined operation termination timing. The predetermined temperature is set to approximately $-0.0091h^2+1.5245h-13.513°$ C. or less where a covering rate of an externally added agent to a toner surface is indicated by h (%).

Also, according to the second embodiment of the present invention, there is provided the image forming program adapted for allowing a computer to execute:

a temperature detection step wherein a temperature is detected relative to a cleaner portion adapted for recovering toner remaining on an image carrying surface of an image carrier;

a temperature determination step wherein it is determined whether or not the detected temperature obtained in the temperature detection step exceeds a first predetermined temperature; and a control step wherein, if it is determined in the temperature detection step that the detected temperature exceeds the first predetermined temperature, a cooling portion adapted for cooling the cleaner portion is additionally operated over a predetermined period of time beyond a predetermined operation termination timing.

In the image forming program as described above, it is preferable that, when the detected temperature in the temperature detection step exceeds the first predetermined temperature prior to the predetermined operation termination timing, the predetermined period of time is an elapsed time from the predetermined operation termination timing to the time when the detected temperature has become less than a second predetermined temperature. Also, in the image forming program, when the detected temperature in the temperature detection step exceeds the first predetermined temperature after the predetermined operation termination timing, the predetermined period of time can be set as an elapsed time between the time when the detected temperature has exceeded the first predetermined temperature and the time when the detected temperature has become less than the second predetermined temperature. Further, the predetermined operation termination timing is set as a timing which is preset in association with the operation of the image forming apparatus. Furthermore, the temperature detection in the temperature detection step is performed at the predetermined operation termination timing. The first predetermined temperature is set to approximately $-0.0091h^2+1.5245h-13.513°$ C. or less where a covering rate of an externally added agent to a toner surface is indicated by h (%).

As described above, some embodiments of the present invention are described in detail, on the assumption that various functions for embodying the present invention are previously stored in the image forming apparatus, but it is not limited to according the present invention. For example, it may be possible to download similar functions onto the image forming apparatus via any network. It will be appreciated by those of ordinary skill in the art that the storage media adapted for storing programs may comprise any one of a flexible disk (FD), a CD-ROM, a DVD disk and the like. Furthermore, any form of the storage media may be available if such a storage medium is readable by the image forming apparatus. Also, there is no problem in the case that the functions which can be previously installed or download onto the image forming apparatus are implemented in cooperation with an operating system within the apparatus.

In the embodiments as described above, a copying paper is used as a sheet as a transfer material but an OHP sheet, an intermediate transfer material and the like may be used therefor.

With the configuration according to the present invention, the fog image and/or the toner clumps is prevented from being generated on the image, thereby securing and providing the high-quality images.

Accordingly, it is possible to stably provide the images without any defect by the image forming apparatus equipped with a toner-recycle mechanism.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiment is therefore to be construed in all aspects as illustrative and not restrictive and all changes coming within the meaning and equivalency range of the appended claims are intended to be embraced therein.

What is claimed is:

1. An image forming apparatus, comprising:

a cleaner portion adapted for recovering toner remaining on an image carrying surface of an image carrier after a toner image formed on the carrying surface of the image carrier has been transferred onto a transfer material;

a recovered-toner transporting portion adapted for transporting the toner recovered by said cleaner portion to a developing portion adapted for supplying the toner onto the image carrying surface;

a temperature detecting portion adapted for detecting a temperature relative to said cleaner portion; and a controlling portion adapted for (1) additionally operating said recovered-toner transporting portion over a predetermined period of time beyond a predetermined operation termination timing when a time when a temperature detected by said temperature detecting portion exceeds a predetermined temperature is after the predetermined operation termination timing, and for (2) operating said recovered-toner transporting portion over a prolongation of only the predetermined period of time from the predetermined operation timing when a time when the temperature has exceeded the predetermined temperature is before the predetermined operation termination timing.

2. An image forming apparatus as claimed in claim 1, wherein said controlling portion is capable of varying, based on the temperature detected by the temperature detecting portion, the predetermined period of time so as to additionally operate said recovered-toner transporting portion.

3. An image forming apparatus as claimed in claim 1, wherein the predetermined operation termination timing is set as a timing which is preset in association with the operation of said image forming apparatus.

4. An image forming apparatus as claimed in claim 1, wherein said temperature detecting portion is disposed in a vicinity of said cleaner portion.

5. An image forming apparatus as claimed in claim 1, wherein the temperature detection by said temperature detecting portion is performed at the predetermined operation termination timing.

6. An image forming apparatus, comprising:

a cleaner portion adapted for recovering toner remaining on an image carrying surface of an image carrier after a toner image formed on the carrying surface of the image carrier has been transferred onto a transfer material;

a recovered-toner transporting portion adapted for transporting the toner recovered by said cleaner portion to a developing portion adapted for supplying the toner onto the image carrying surface;

a temperature detecting portion adapted for detecting a temperature relative to said cleaner portion; and a controlling portion adapted for additionally operating said recovered-toner transporting portion over a predetermined period of time beyond a predetermined operation termination timing when the temperature detected by said temperature detecting portion exceeds a predetermined temperature, wherein the predetermined temperature is set to approximately $-0.0091h^2+1.5245h-13.513°$ C. or less where a covering rate of an externally added agent to a toner surface is indicated by h (%).

7. An image forming apparatus as claimed in claim 6, wherein said recovered-toner transporting portion is additionally operated with a prolongation of only the predetermined period of time from the predetermined operation timing when the temperature detected by said temperature detecting portion exceeds the predetermined temperature prior to the predetermined operation termination timing.

8. An image forming apparatus, comprising:

a cleaner portion adapted for recovering toner remaining on an image carrying surface of an image carrier after a toner image formed on the carrying surface of the image carrier has been transferred onto a transfer material;

a cooling portion adapted for cooling said cleaner portion;

a temperature detecting portion adapted for detecting a temperature relative to said cleaner portion; and a controlling portion adapted for additionally operating said cooling portion over a predetermined period of time beyond a predetermined operation termination timing when the temperature detected by said temperature detecting portion exceeds a first predetermined temperature, wherein the predetermined period of time is an elapsed time from the predetermined operation termination timing to the time when the detected temperature has become less than a second predetermined temperature when the temperature detected by said temperature detecting portion exceeds the first predetermined temperature prior to the predetermined operation termination timing, wherein the predetermined period of time is an elapsed time between the time when the detected temperature has exceeded the first predetermined temperature and the time when the detected temperature has become less than a second predetermined temperature when the temperature detected by said temperature detecting portion exceeds the first predetermined temperature after the predetermined operation termination timing.

9. An image forming apparatus as claimed in claim 8, wherein the predetermined operation termination timing is set as a timing which is preset in association with the operation of said image forming apparatus.

10. An image forming apparatus as claimed in claim 8, wherein said temperature detecting portion is disposed in a vicinity of said cleaner portion.

11. An image forming apparatus as claimed in claim 8, wherein the temperature detection by said temperature detecting portion is performed at the predetermined operation termination timing.

12. An image forming apparatus, comprising:

a cleaner portion adapted for recovering toner remaining on an image carrying surface of an image carrier after a toner image formed on the carrying surface of the image carrier has been transferred onto a transfer material;

a cooling portion adapted for cooling said cleaner portion;

a temperature detecting portion adapted for detecting a temperature relative to said cleaner portion; and a controlling portion adapted for additionally operating said cooling portion over a predetermined period of time beyond a predetermined operation termination timing when the temperature detected by said temperature detecting portion exceeds a first predetermined temperature, wherein the first predetermined temperature is set to approximately $-0.0091h^2+1.5245h-13.513°$ C. or less where a covering rate of an externally added agent to a toner surface is indicated by h (%).

13. An image forming method, comprising:

a temperature detection step wherein a temperature is detected relative to a cleaner portion adapted for recovering toner remaining on an image carrying surface of an image carrier;

a temperature determination step wherein it is determined whether or not the detected temperature obtained in said temperature detection step exceeds a predetermined temperature; and a control step wherein, (1) if it is determined in said temperature detection step that the detected temperature exceeds the predetermined temperature at a time after a predetermined operation timing, then a recovered-toner transporting portion adapted for transporting toner recovered by said cleaner portion toward a developing portion adapted for supplying the toner to the carrier surface of the image carrier is additionally operated over a predetermined period of time beyond a predetermined operation termination timing, and (2) if it is determined in said temperature determination step that the detected temperature exceeds the predetermined temperature at a time before a predetermined operation timing, then the recovered-toner transporting portion is operated over a prolongation of only the predetermined period of time from the predetermined operation timing.

14. An image forming method as claimed in claim 13, wherein the predetermined period of time to be added for the operation in said control step is varied based on the temperature detected in said temperature detection step.

15. An image forming method as claim 13, wherein the predetermined operation termination timing is set as a timing which is preset.

16. An image forming method as claimed in claim 13, wherein the temperature detection in said temperature detection step is performed at the predetermined operation termination timing.

17. An image forming method, comprising:

a temperature detection step wherein a temperature is detected relative to a cleaner portion adapted for recovering toner remaining on an image carrying surface of an image carrier;

a temperature determination step wherein it is determined whether or not the detected temperature obtained in said temperature detection step exceeds a predetermined temperature; and a control step wherein, if it is determined in said temperature determination step that the detected temperature exceeds the predetermined temperature, then a recovered-toner transporting portion adapted for transporting toner recovered by said cleaner portion toward a developing portion adapted for supplying the toner to the carrier surface of the image carrier is additionally operated over a predetermined period of time beyond a predetermined operation termination timing, wherein the predetermined temperature is set to approximately $-0.0091h^2+1.5245h-13.513°$ C. or less where a covering rate of an externally added agent to a toner surface is indicated by h (%).

18. An image forming method as claimed in claim 17, wherein, in said control step, said recovered-toner transporting portion is additionally operated with a prolongation of only the predetermined period of time from the predetermined operation timing when the detected temperature in said temperature detection step exceeds the predetermined temperature prior to the predetermined operation termination timing.

19. An image forming method, comprising the steps:

a temperature detection step wherein a temperature is detected relative to a cleaner portion adapted for recovering toner remaining on an image carrying surface of an image carrier;

a temperature determination step wherein it is determined whether or not the detected temperature obtained in said temperature detection step exceeds a first predetermined temperature; and a control step wherein, if it is determined in said temperature detection step that the detected temperature exceeds the first predetermined temperature, then a cooling portion adapted for cooling said cleaner portion is additionally operated over a predetermined period of time beyond a predetermined operation termination timing, wherein the predetermined period of time is an elapsed time from the predetermined operation termination timing to the time when the detected temperature has become less than a second predetermined temperature when the detected temperature in said temperature detection step exceeds the first predetermined temperature prior to the predetermined operation termination timing, wherein the predetermined period of time is set as an elapsed time between the time when the detected temperature has exceeded the first predetermined temperature and the time when the detected temperature has become less than the second predetermined temperature when the detected temperature in said temperature detection step exceeds the first predetermined temperature after the predetermined operation termination timing.

20. An image forming method as claimed in claim 19, wherein the predetermined operation termination timing is set as a timing which is preset.

21. An image forming method as claimed in claim 19, wherein the temperature detection in said temperature detection step is performed at the predetermined operation termination timing.

22. An image forming method, comprising the steps:

a temperature detection step wherein a temperature is detected relative to a cleaner portion adapted for recovering toner remaining on an image carrying surface of an image carrier;

a temperature determination step wherein it is determined whether or not the detected temperature obtained in said temperature detection step exceeds a first predetermined temperature; and a control step wherein, if it is determined in said temperature determination step that the detected temperature exceeds the first predetermined temperature, then a cooling portion adapted for cooling said cleaner portion is additionally operated over a predetermined period of time beyond a predetermined operation termination timing, wherein the first predetermined temperature is set to approximately $-0.0091h^2+1.5245h-13.513°$ C. or less where a covering rate of an externally added agent to a toner surface is indicated by h (%).

* * * * *